US008303351B2

(12) United States Patent
Taguchi et al.

(10) Patent No.: US 8,303,351 B2
(45) Date of Patent: Nov. 6, 2012

(54) DISTRIBUTION TERMINAL FOR WIRE-TYPE FUSIBLE LINK AND FUSE CONNECTION STRUCTURE USING DISTRIBUTION TERMINAL

(75) Inventors: Naoto Taguchi, Makinohara (JP); Mitsuhiko Totsuka, Makinohara (JP)

(73) Assignee: Yazaki Corporation, Tokyo (JP)

( * ) Notice: Subject to any disclaimer, the term of this patent is extended or adjusted under 35 U.S.C. 154(b) by 273 days.

(21) Appl. No.: 12/760,930

(22) Filed: Apr. 15, 2010

(65) Prior Publication Data

US 2010/0273365 A1 Oct. 28, 2010

(30) Foreign Application Priority Data

Apr. 27, 2009 (JP) ..... 2009-107804

(51) Int. Cl.
*H01R 4/42* (2006.01)

(52) U.S. Cl. ..... 439/763; 439/907; 439/620.26

(58) Field of Classification Search ..... 439/763, 439/754, 880, 907, 620.26
See application file for complete search history.

(56) References Cited

U.S. PATENT DOCUMENTS

| | | | | |
|---|---|---|---|---|
| 4,371,230 | A * | 2/1983 | Inoue | 439/849 |
| 4,531,806 | A * | 7/1985 | Hsieh | 439/620.29 |
| 5,645,448 | A * | 7/1997 | Hill | 439/522 |
| 5,733,152 | A * | 3/1998 | Freitag | 439/763 |
| 5,800,219 | A * | 9/1998 | Siedlik et al. | 439/762 |
| 6,461,172 | B2 * | 10/2002 | Ross | 439/78 |
| 6,476,325 | B2 * | 11/2002 | Kondo | 174/84 C |
| 7,125,295 | B2 * | 10/2006 | Zhao et al. | 439/883 |

FOREIGN PATENT DOCUMENTS

JP 54-48382 U 4/1979

* cited by examiner

*Primary Examiner* — Xuong Chung Trans
(74) *Attorney, Agent, or Firm* — Sughrue Mion, PLLC

(57) ABSTRACT

A distribution terminal for a wire-type fusible link is provided. The distribution terminal includes: an electrically-conductive metal plate having a fixing hole formed therethrough so as to be fastened to a battery terminal bolt; and a plurality of press-clamping barrels formed on the metal plate and provided corresponding respectively to a plurality of wire-type fusible links, each of the press-clamping barrels having a press-fastening leg for being press-clamped to a fusible conductor of the corresponding wire-type fusible link.

7 Claims, 5 Drawing Sheets

DISTRIBUTION TERMINAL FOR WIRE-TYPE FUSIBLE LINK AND FUSE CONNECTION STRUCTURE USING DISTRIBUTION TERMINAL

BACKGROUND OF THE INVENTION

1. Technical Field

The present invention relates to a distribution terminal for a wire-type fusible link, and more particularly to an improved technique for securing the reliability when a multi-way connection is used.

2. Background Art

As disclosed for example in JP-UM-A-54-48382, an FLW (Fusible Link Wire) which is a wire-type fusible link includes a fusible conductor, a first insulator coated on the fusible conductor, and a second insulator coated on the first insulator. The first insulator withstands high temperatures when the fusible conductor is melted, and the second insulator is fused and changed in color when the fusible conductor is melted. With respect to the structure of a fuse using an FLW, so-called LA (an abbreviation of an automotive eyelet terminal in JIS) terminals (eyelet terminals) 503 and 503 or ordinary terminals are crimped respectively to opposite ends of the FLW 50 to provide an input portion 505 and an output portion 507, respectively, as shown in FIG. 6.

In a typical example of use, the LA terminal 503 of the input portion 505 is fastened and connected (threadedly fastened) by a nut 513 to a battery terminal bolt 511 formed on a battery terminal 509, as shown in FIG. 7A. When a multi-way connection is used, a plurality of LA terminals 503 and 503 are superposed together, and are threadedly fastened to the battery terminal bolt 511 as shown in FIG. 7B. It has also been proposed to meet a multi-way connection by providing a structure in which fusible conductors are joined together, and are crimped to a crimp portion of an LA terminal 503 (by so-called double crimping) as shown in FIG. 7C.

However, in the fuse structure using the FLW, when the LA terminals 503 and 503 are used in the superposed condition as shown in FIG. 7B so as to meet the multi-way connection, the number of contact points at the portions threadedly fastened to the battery terminal 509 increases, so that the reliability is not entirely satisfactory. Namely, the plurality of terminals are held together in a multi-layer condition with a predetermined fastening force by a bolt-and-nut arrangement including the fastening means 511 and 513, and therefore areas of contact (contact points) of the terminals increase, and therefore press-contacting forces of the contact points are liable to be lowered and also to become uneven. Particularly with respect to the double crimping shown in FIG. 7C, although the number of contact points at the threadedly-fastened portion does not increase, there is a possibility that the cross-sectional area of each wire may be decreased by the crimping, and it is not certain which portion of the fusible conductor of each FLW is decreased in cross-sectional area and also how much the cross-sectional area is decreased, and it was expected that variations in these became large. As a result, there was a possibility that melting characteristics of the FLWs 501 might be varied.

SUMMARY OF THE INVENTION

The present invention has been made in view of the above circumstances, and an object of the invention is to provide a distribution terminal for a wire-type fusible link which can secure a reliability of a fastened portion equivalent to a reliability of a fastened portion of an ordinary LA terminal even when a multi-way connection is used.

In order to achieve the above object of the present invention, there is provided a distribution terminal for a wire-type fusible link, comprising:

an electrically-conductive metal plate having a fixing hole formed therethrough so as to be fastened to a battery terminal bolt; and a plurality of press-clamping barrels formed on the metal plate and provided corresponding respectively to a plurality of wire-type fusible links, each of the press-clamping barrels having a press-fastening leg for being press-clamped to a fusible conductor of the corresponding wire-type fusible link.

In the distribution terminal for the wire-type fusible link, the fixing hole is fastened to the battery terminal bolt, thus providing a single-layer press-contacting connection structure as is the case with the fastening of an ordinary eyelet terminal. With respect to the metal plate, the wire-type fusible links are individually press-clamped to the press-clamping barrels, respectively, and thus a press-clamping connection structure is provided for each of the wire-type fusible links.

The distribution terminal may be configured in that the metal plate has a rectangular shape, and is longitudinally bent into an L-shape defined by a horizontal part and a vertical part; the fixing hole is formed through the horizontal part; and the plurality of press-clamping barrels are formed on the vertical part, and are spaced from one another in a longitudinal direction of the vertical part.

Further, the distribution terminal may be configured in that the horizontal part of the metal plate is shorter in length than the vertical plate.

In this distribution terminal, the horizontal part is disposed parallel to an upper surface of a battery, and the vertical part is disposed parallel to a vertical surface of the battery. Therefore, the amount of projecting of the distribution terminal in a horizontal direction can be reduced, and the plurality of press-clamping barrels can be arranged in spaced relation to each other in the vertical direction, and this enables a space-saving design of an engine room.

The distribution terminal may be configured in that opposite side edges of the metal plate are bent toward an internal corner side of the L-shaped metal plate to form a pair of opposed reinforcing ribs extending along the horizontal part and the vertical part.

In the distribution terminal, the strength of the metal plate bent into the L-shape can be increased. The pair of reinforcing ribs serve to hold the battery terminal therebetween, thereby preventing the metal plate from being rotated about the battery terminal bolt relative to the battery terminal. Furthermore, a surface area of the metal plate can be increased, thereby enhancing a heat radiating ability.

The distribution terminal may be configured in that the press-fastening leg of the press-clamping barrel has a pair of legs disposed parallel to opposite sides of the vertical part.

Further, the distribution terminal may be configured in that a withdrawal prevention part that bites into the fusible conductor is provided between the pair of legs.

In the distribution terminal, the wire-type fusible links can be connected to the distribution terminal in spaced relation to each other in the longitudinal direction (the upward-downward direction) of the vertical part. Thus, the plurality of wire-type fusible links are not arranged in the widthwise direction of the vertical part, and therefore the widthwise dimension of the distribution terminal is prevented from increasing. The withdrawal prevention means bites into the fusible conductor press-clamped by the pair of press-fastening legs, thereby positively preventing the fusible portion from being withdrawn from the press-clamping barrel.

There may be provided a fuse connection structure using the distribution terminal, wherein: input sides of the wire-type fusible links are press-clamped respectively to the plurality of press-clamping barrels; and output sides of the wire-type fusible links are connected respectively to connector terminals arranged side by side in a direction which is parallel to a surface of the vertical part and along which the opposite sides of the vertical part are spaced from each other, so that the wire-type fusible links are spaced from each other.

In the fuse connection structure using the above distribution terminal, the output sides of the wire-type fusible links (whose input sides are connected to the vertical part) are connected respectively to the connector terminals in spaced relation to each other in the right-left direction. Therefore, the wire-type fusible links are spaced from each other, and a thermal interference can be prevented from occurring between the wire-type fusible links.

In the distribution terminal of the present invention for the wire-type fusible link, its fastening portion for being fastened to the battery terminal is one portion, that is, the fixing hole formed through the metal plate, and therefore the reliability equivalent to a reliability obtained in the fastening of an ordinary eyelet terminal can be secured. With respect to the press-clamping portions for the wire-type fusible links, the distribution terminal has the separate press-clamping barrels corresponding respectively to the wire-type fusible links, and therefore even when a multi-way connection is used, the reliability of the press-clamping portions can be secured.

In the fuse connection structure using the distribution terminal of the invention for the wire-type fusible link, the output sides of the wire-type fusible links are connected respectively to the connector terminals arranged side by side in the direction of spacing of the opposite side portions of the vertical part from each other. Therefore, the wire-type fusible links are spaced from each other, and a thermal interference can be prevented from occurring between the wire-type fusible links. Therefore, there can be obtained the fuse connection structure of a high quality in which when any of the fusible links is melted, any effects resulting therefrom will not be applied to the other fusible links, so that the melting characteristics will not be varied.

DETAILED DESCRIPTION OF THE EXEMPLARY EMBODIMENTS

An exemplary embodiment of the present invention will now be described with reference to the drawings.

Figure 1:
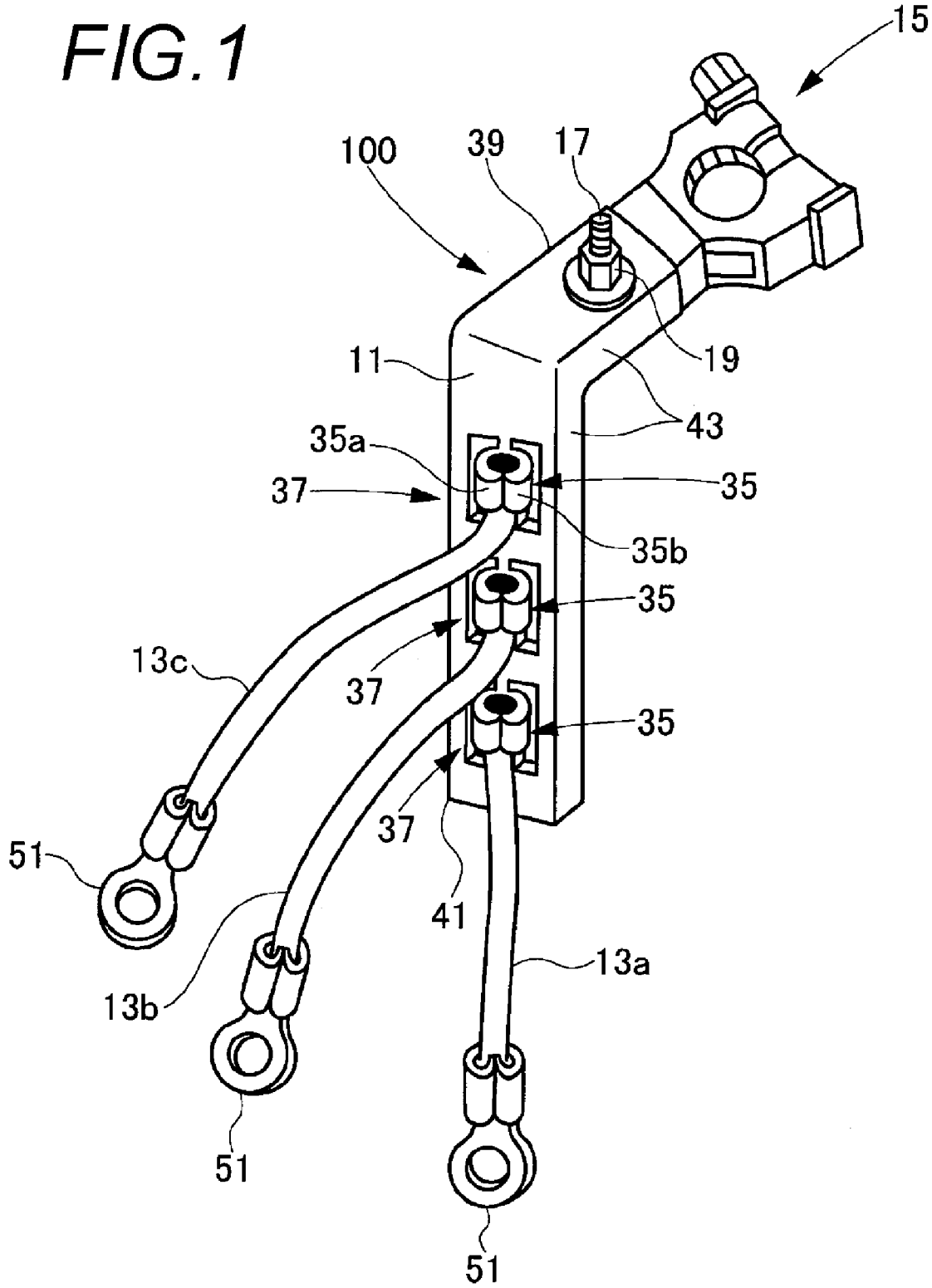
FIG. 1 is a perspective view of a distribution terminal according to an embodiment of the present invention for a wire-type fusible link, showing a condition in which fusible links are connected to the distribution terminal.
Figure 2:
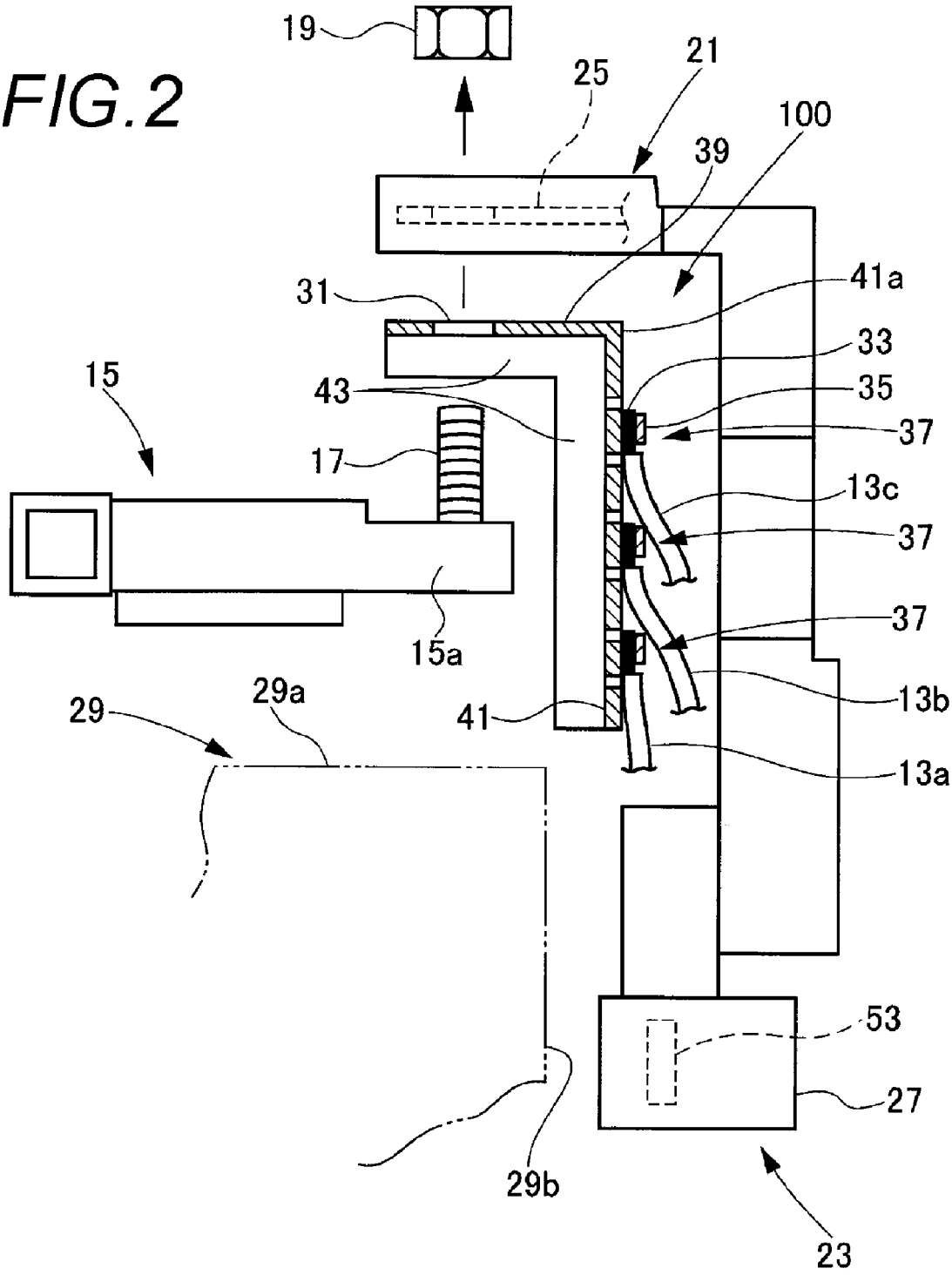
FIG. 2 is an exploded side-elevational view showing the manner of mounting the distribution terminal on a fusible link unit.

FIG. 1 is a perspective view of a distribution terminal according to a embodiment of the invention for a wire-type fusible link, showing a condition in which fusible links are connected to the distribution terminal, and FIG. 2 is an exploded side-elevational view showing the manner of mounting the distribution terminal on a fusible link unit.

The distribution terminal 100 of this embodiment for the wire-type fusible link (hereinafter often referred to merely as "distribution terminal") is formed by pressing and bending an electrically-conductive metal plate or sheet 11, and has a one-piece construction. A plurality of wire-type fusible links (FLWs: Fusible link Wires) 13*a*, 13*b* and 13*c* are press-clamped at their one ends to the distribution terminal 100. The distribution terminal 100 having the FLWs 13*a*, 13*b* and 13*c* press-clamped thereto is threadedly fastened to a battery terminal bolt 17 of a battery terminal 15 by a nut 19.

As shown in FIG. 1, although the distribution terminal 100 may be alone connected to the battery terminal 15, it can also be used in a connection portion 23 for an optional circuit fastened to the fusible link unit 21. As shown in FIG. 2, there are also provided a fuse element 25 having a plurality of fusible portions, an optional connector 27 of the connection portion 23 for the optional circuit, and a battery 29.

Figure 3:
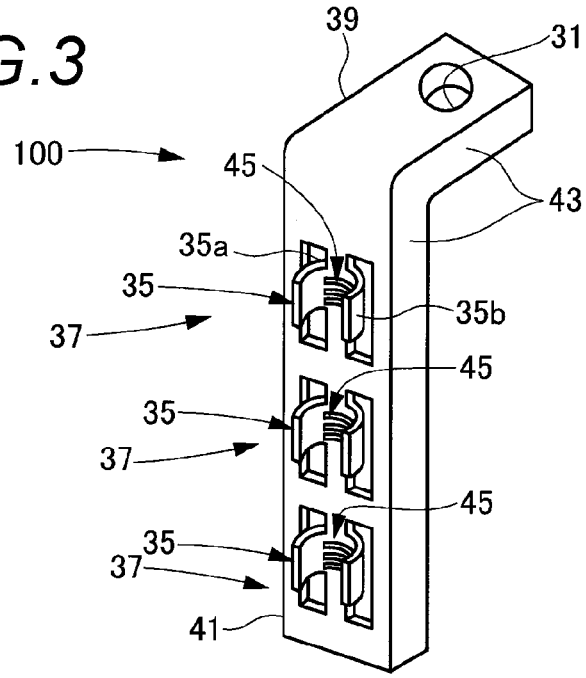
FIG. 3 is a perspective view of the distribution terminal for the wire-type fusible link.
Figure 4A:
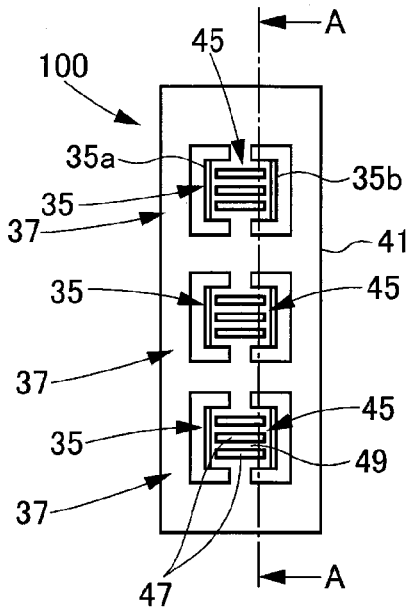
FIG. 4A is a front-elevational view of the distribution terminal of FIG. 3.
Figure 4B:
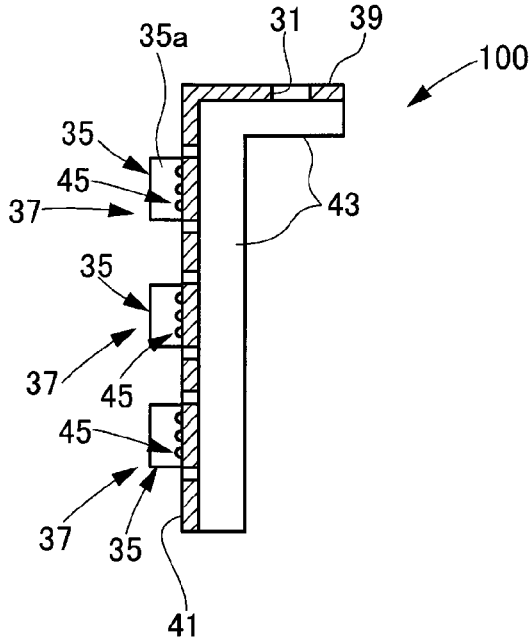
FIG. 4B is a cross-sectional view taken along the line A-A of FIG. 4A.
Figure 4C:
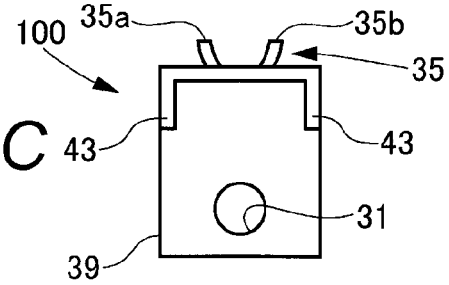
FIG. 4C is a bottom view of the distribution terminal.

FIG. 3 is a perspective view of the distribution terminal for the wire-type fusible link, FIG. 4A is a front-elevational view of the distribution terminal of FIG. 3, FIG. 4B is a cross-sectional view taken along the line A-A of FIG. 4A, and FIG. 4C is a bottom view of the distribution terminal.

The metal plate 11 has a fixing hole 31 formed therethrough so as to be fastened to the battery terminal bolt 17. The metal plate 11 further includes a plurality of press-clamping barrels 37 for being press-clamped respectively to fusible conductors 33 (see FIG. 2) of the FLWs 13*a*, 13*b* and 13*c*, and more specifically each press-clamping barrel 37 has a pair of press-fastening legs (also referred to merely as "a pair of legs") 35 for being press-fastened on the fusible conductor 33 of the corresponding FLW.

In this embodiment, the metal plate 11 has a rectangular shape, and is longitudinally bent into an L-shape defined by a shorter horizontal part 39 and a longer vertical part 41. The fixing hole 31 is formed through the horizontal part 39. The plurality of press-clamping barrels 37 are formed on the vertical part 41, and are spaced from one another in the longitudinal direction (upward-downward direction in FIG. 1) of the vertical part 41.

The metal plate 11 is bent into the L-shape, so that the horizontal part 39 is disposed parallel to an upper surface 29*a* (see FIG. 2) of the battery 29, and the vertical part 41 is disposed parallel to a vertical surface 29*b* of the battery 29. With this arrangement, the amount of projecting of the distribution terminal in the horizontal direction can be reduced, and also the plurality of press-clamping barrels 37 can be arranged in spaced relation to one another in the vertical direction, and this enables a space-saving design of an engine room.

Opposite side edges (right and left edges in FIG. 4A) of the metal plate 11 are bent toward the internal corner side of the L-shaped metal plate 11 to form a pair of opposed reinforcing ribs 43 and 43 extending along the horizontal part 39 and the vertical part 41. With this construction, the strength of the metal plate 11 bent into the L-shape can be increased. The pair of reinforcing ribs 43 and 43 also serve to hold a fastening portion 15*a* (see FIG. 2) of the battery terminal 15 therebetween, thereby preventing the metal plate 11 from being rotated about the battery terminal bolt 17 relative to the battery terminal 15. Furthermore, the provision of the reinforcing ribs 43 and 43 increases a surface area of the metal plate, thereby achieving a secondary effect of enhancing a heat radiating ability.

The press-clamping barrel 37 has the pair of press-fastening legs 35*a* and 35*b* disposed parallel to the opposite side portions of the vertical part 41. The pair of press-fastening legs 35*a* and 35*b* can be formed, for example, by stamping relevant portions out from the vertical part 41. A withdrawal prevention part 45 that bites into the fusible conductor 33 is provided between the pair of press-fastening legs 35*a* and 35*b* of the press-clamping barrel 37. In this embodiment, the withdrawal prevention part 45 includes a plurality of parallel ridges 47 (see FIG. 4) arranged in the upward-downward direction. Therefore, a groove 47 (see FIG. 4) is formed between any two adjacent ridges 47. The alternate ridge 47 and grooves 49 forming the withdrawal prevention part 45 can be replaced by a plurality of parallel slots arranged in the upward-downward direction.

The plurality of pairs of press-clamping legs 35*a* and 35*b* are thus formed at the vertical part 41, and are disposed parallel to the opposite side portions of the vertical part 41. Therefore, the FLWs 13*a*, 13*b* and 13*c* can be connected to the distribution terminal in spaced relation to one another in the longitudinal direction (the upward-downward direction) of the vertical part 41. Thus, the plurality of FLWs 13*a*, 13*b* and 13*c* are not arranged in the widthwise direction (the right-left direction in FIG. 4A) of the vertical part 41, and therefore the widthwise dimension of the distribution terminal is prevented from increasing.

The withdrawal prevention part 45 is provided between the pair of press-fastening legs 35*a* and 35*b*, and therefore when the pair of press-fastening legs 35*a* and 35*b* are press-clamped to the fusible conductor 33, the withdrawal prevention part 45 bites into this fusible conductor 33, thereby positively preventing the fusible portion 33 from being withdrawn from the press-clamping barrel 37.

In each of the FLWs 13*a*, 13*b* and 13*c*, one end portion (input side) of the fusible conductor 33 is press-clamped to the press-clamping barrel 37, and an LA terminal (automotive eyelet terminal) 51 or an ordinary terminal is press-clamped to the other end portion (output side) of the fusible conductor 33. The LA terminal or the ordinary terminal is connected to a load-side circuit (not shown). When the distribution terminal 100 is used in the connection portion 23 (see FIG. 2) for the optional circuit, the LA terminals 51 or the ordinary terminals are connected to the optional connector 27.

Figure 5A:
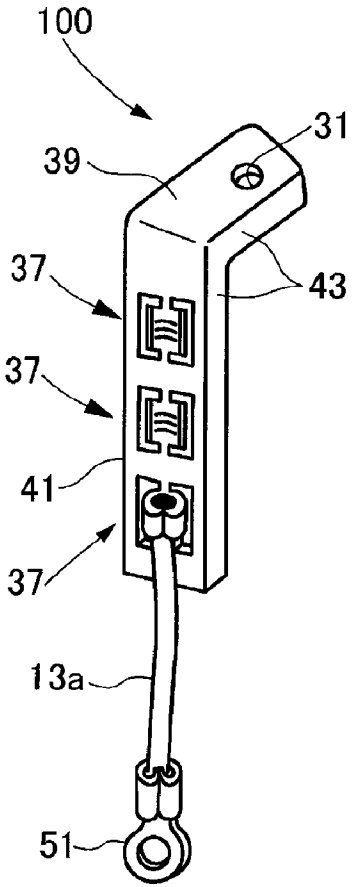
FIGS. 5A to 5C are perspective views showing examples of use of the distribution terminal of FIG. 3.
Figure 5B:
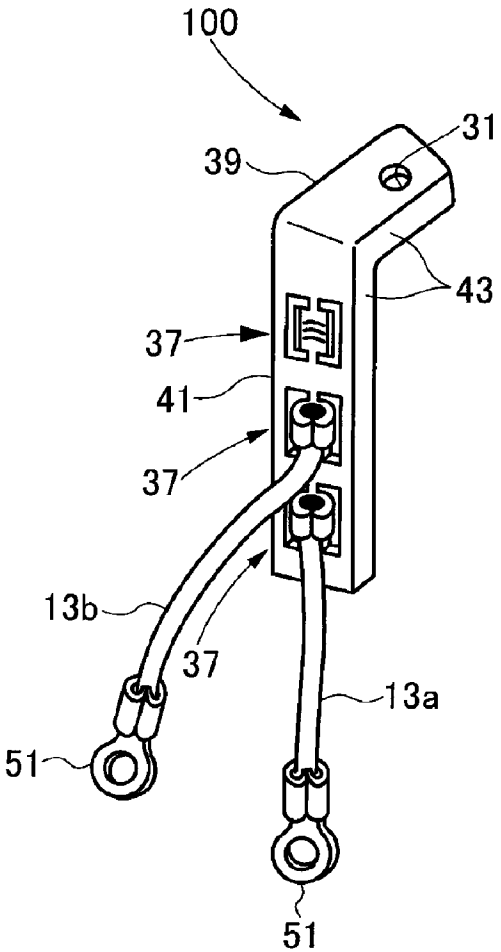
Figure 5C:
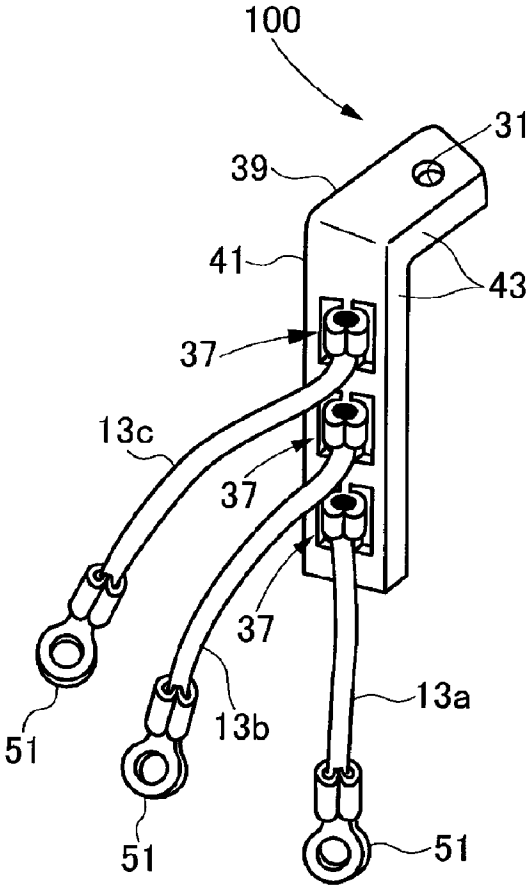
Figure 6:
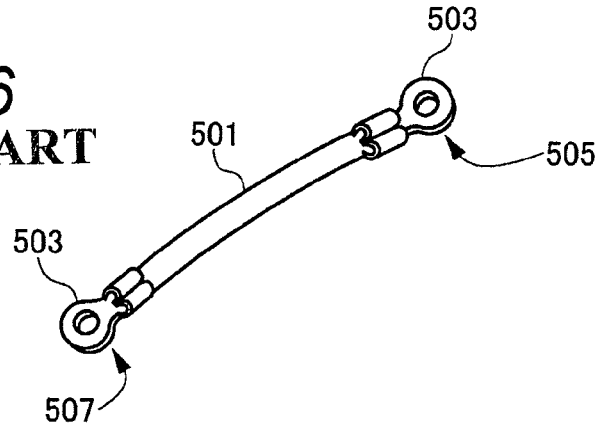
FIG. 6 PRIOR ART
FIG. 6 is a conventional wire-type fusible link.
Figure 7A:
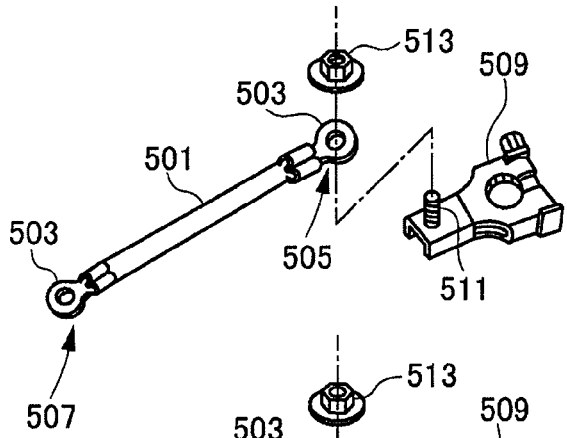
FIG. 7A PRIOR ART
FIGS. 7A to 7C are exploded perspective views showing examples of use of the conventional wire-type fusible link.
Figure 7B:
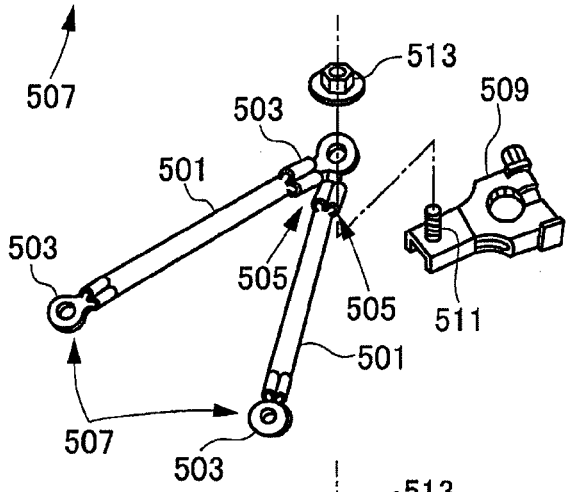
FIG. 7B PRIOR ART
Figure 7C:
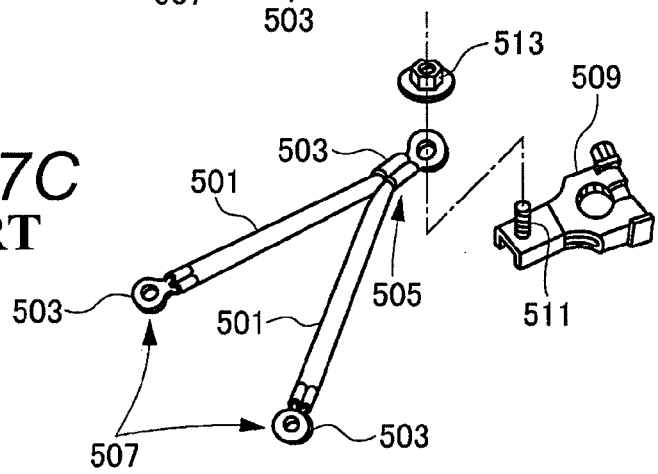
FIG. 7C PRIOR ART

FIGS. 5A to 5C are perspective views showing examples of use of the distribution terminal of FIG. 3 for the wire type-fusible link.

One or more of the FLWs 13*a*, 13*b* and 13*c* are connected to the press-clamping barrels 37, 37 and 37 of the distribution terminal 100 according to the number of distribution circuits. Namely, when only one distribution circuit is provided, the FLW 13*a* is press-clamped and connected to the lowermost press-clamping barrel 37 as shown in FIG. 5A. When there are provided two distribution circuits, the FLWs 13*a* and 13*b* are press-clamped respectively to the lowermost and intermediate press-clamping barrels 37 and 37 as shown in FIG. 5B. When there are provided three distribution circuits, the FLWs 13*a*, 13*b* and 13*c* are press-clamped respectively to the lowermost, intermediate and uppermost press-clamping barrels 37, 37 and 37 as shown in FIG. 5C.

For example, when the distribution terminal 100 having the FLWs 13*a*, 13*b* and 13*c* press-clamped thereto is used in the connection portion 23 (see FIG. 2) for the optional circuit, the output sides of the FLWs 13*a*, 13*b* and 13*c* are connected respectively to a plurality of connector terminals 53 (only one of which is shown in FIG. 2) arranged side by side in a direction (direction perpendicular to the sheet of FIG. 2) which is parallel to a surface 41*a* of the vertical part 41 and along which the opposite side portions of the vertical part 41 are spaced from each other. Namely, three connector terminals 53 are arranged side by side in the direction perpendicular to the sheet of FIG. 2. With this arrangement, the three FLWs 13*a*, 13*b* and 13*c* are spaced from one another.

When the distribution terminal 100 is thus used in the connection portion 23 of the fusible link unit 21 for the optional circuit, the input sides of the FLWs 13*a*, 13*b* and 13*c* are connected to the vertical part 41, while the output sides of these FLWs are connected respectively to the connector terminals 53 in spaced relation to one another in the right-left direction. Therefore, the FLWs 13*a*, 13*b* and 13*c* are spaced from one anther (see FIG. 5C), so that a thermal interference will not occur between the FLWs 13*a*, 13*b* and 13*c*.

As described above, in the distribution terminal 100, the fixing hole 31 is fastened to the battery terminal bolt 17, thus providing a single-layer press-contacting connection structure as is the case with the fastening of an ordinary eyelet terminal. With respect to the metal plate 11, the FLWs 13*a*, 13*b* and 13*c* are individually press-clamped to the press-clamping barrels 37, 37 and 37, respectively, and thus a press-clamping connection structure is provided for each of the FLWs 13*a*, 13*b* and 13*c*.

Therefore, in the distribution terminal 100 of this embodiment, its fastening portion for being fastened to the battery terminal 15 is one portion, that is, the fixing hole 31 formed through the metal plate 11, and therefore the reliability equivalent to a reliability obtained in the fastening of an ordinary eyelet terminal can be secured. With respect to the press-clamping portions for the FLWs 13*a*, 13*b* and 13*c*, the distribution terminal 100 has the separate press-clamping barrels 37 corresponding respectively to the FLWs 13*a*, 13*b* and 13*c*, and therefore even when a multi-way connection is used, the reliability of the press-clamping portions can be secured.

Furthermore, in the fuse connection structure using the distribution terminal of this embodiment for the wire-type fusible link, the output sides of the FLWs 13*a*, 13*b* and 13*c* are connected respectively to the connector terminals 53 arranged side by side in the direction of spacing of the opposite side portions of the vertical part 41 from each other. Therefore, the FLWs 13*a*, 13*b* and 13*c* are spaced from one another, and a thermal interference can be prevented from occurring between the FLWs 13*a*, 13*b* and 13*c*. Therefore, there can be obtained the fuse connection structure of a high quality in which when any of the fusible links is melted, any effects resulting therefrom will not be applied to the other fusible links, so that the melting characteristics will not be varied.

The present invention has been explained in detail with reference to the particular embodiments. However, various variations and modifications can be applied.

In the above-mentioned embodiment, there are provided three press-clamping barrels, as shown in the figures, for being press-fastened on the fusible conductor 33 of the corresponding FLW. However, the number of the press-clamping barrels is not limited thereto, and two, or four or more press-clamping barrels may be provided so as to spaced from each other.

In the above-mentioned embodiment, the metal plate 11 is longitudinally bent into the L-shape defined by a shorter horizontal part 39 and a longer vertical part 41. That is, the horizontal part 39 is shorter in length than the vertical part 41. However, the horizontal part 39 may be formed to be equal to or longer than the vertical part 41 in length, depending on the situation, such as a space restriction or a design restriction in a vehicle.

What is claimed is:

1. A distribution terminal for a wire-type fusible link, comprising:

an electrically-conductive metal plate having a fixing hole formed therethrough so as to be fastened to a battery terminal bolt, said metal plate having an L-shape defined by a first leg having the fixing hole therein and a second leg extending perpendicular from the first leg; and at least three press-clamping barrels formed on the second leg of the metal plate and provided corresponding respectively to a plurality of wire-type fusible links, each of the press-clamping barrels having a pair of press-fastening legs for being press-clamped to a fusible conductor of the corresponding wire-type fusible link, wherein the press-clamping barrels are aligned with, and spaced from, each other along a length of the second leg.

2. The distribution terminal according to claim 1, wherein:

the first leg is a horizontal part extending horizontally and the second leg is a vertical part extending vertically.

3. The distribution terminal according to claim 2, wherein the horizontal part of the metal plate is shorter in length than the vertical plate.

4. The distribution terminal according to claim 2, wherein opposite side edges of the metal plate are bent toward an internal corner side of the L-shaped metal plate to form a pair of opposed reinforcing ribs extending along the horizontal part and the vertical part.

5. The distribution terminal according to claim 2, wherein the press-fastening leg of the press-clamping barrel has a pair of legs disposed parallel to opposite sides of the vertical part.

6. The distribution terminal according to claim 5, wherein a withdrawal prevention part that bites into the fusible conductor is provided between the pair of legs.

7. A fuse connection structure using the distribution terminal as defined in claim 2, wherein:

input sides of the wire-type fusible links are press-clamped respectively to the plurality of press-clamping barrels; and output sides of the wire-type fusible links are connected respectively to connector terminals arranged side by side in a direction which is parallel to a surface of the vertical part and along which the opposite sides of the vertical part are spaced from each other, so that the wire-type fusible links are spaced from each other.

* * * * *